US008715378B2

(12) United States Patent
Livshits et al.

(10) Patent No.: US 8,715,378 B2
(45) Date of Patent: May 6, 2014

(54) FLUID COMPOSITE, DEVICE FOR PRODUCING THEREOF AND SYSTEM OF USE

(75) Inventors: David Livshits, San Francisco, CA (US); Lester Teichner, Chicago, IL (US)

(73) Assignee: Turbulent Energy, LLC, Buffalo, NY (US)

( * ) Notice: Subject to any disclaimer, the term of this patent is extended or adjusted under 35 U.S.C. 154(b) by 475 days.

(21) Appl. No.: 12/859,121

(22) Filed: Aug. 18, 2010

(65) Prior Publication Data

US 2011/0030827 A1 Feb. 10, 2011

Related U.S. Application Data

(63) Continuation-in-part of application No. 12/529,625, filed as application No. PCT/US2008/075374 on Sep. 5, 2008.

(60) Provisional application No. 60/970,655, filed on Sep. 7, 2007, provisional application No. 60/974,909, filed on Sep. 25, 2007, provisional application No. 60/978,932, filed on Oct. 10, 2007, provisional application No. 61/012,334, filed on Dec. 7, 2007, provisional application No. 61/012,337, filed on Dec. 7, 2007, provisional application No. 61/012,340, filed on Dec. 7, 2007, provisional application No. 61/037,032, filed on Mar. 17, 2008.

(51) Int. Cl.
*C10L 5/00* (2006.01)

(52) U.S. Cl.
USPC ..... 44/629; 366/162.4; 366/336; 366/337; 366/338; 261/76; 261/77

(58) Field of Classification Search
USPC ..... 44/629; 366/162.4, 336, 337, 338; 261/76, 77
See application file for complete search history.

(56) References Cited

U.S. PATENT DOCUMENTS 456,828 A * 7/1891 Korting ..... 261/76
2,295,740 A 9/1942 Keen (Continued)

FOREIGN PATENT DOCUMENTS

DE 3723618 12/1988
DE 4211031 10/1993

(Continued)

OTHER PUBLICATIONS

International Search Report for International Application No. PCT/US2008/75366, Nov. 13, 2008, 2 pp.

(Continued)

*Primary Examiner* — Cephia D Toomer
(74) *Attorney, Agent, or Firm* — Vedder Price P.C.

(57) ABSTRACT

The current disclosure relates to a new fluid composite, a device for producing the fluid composite, and a method of production therewith, and more specifically a fluid composite made of a fuel and its oxidant for burning as part of different systems such as fuel burners, where the fluid composite after a stage of intense molecular between a controlled flow of a liquid such as fuel and a faster flow of compressed highly directional gas such as air results in the creation of a three dimensional matrix of small hallow spheres each made of a layer of fuel around a volume of pressurized gas. In an alternate embodiment, external conditions such as inline pressure warps the spherical cells into a network of oblong shape cells where pressurized air is used as part of the combustion process. In yet another embodiment, additional gas such as air is added via a second inlet to increase the proportion of oxidant to carburant as part of the mixture.

3 Claims, 11 Drawing Sheets

(56) References Cited

U.S. PATENT DOCUMENTS

| | | | |
|---|---|---|---|
| 3,735,778 | A | 5/1973 | Garnier |
| 3,980,233 | A | 9/1976 | Simmons et al. |
| 4,215,081 | A | 7/1980 | Brooks |
| 4,218,012 | A | 8/1980 | Hamza et al. |
| 4,398,827 | A | 8/1983 | Dietrich |
| 4,399,107 | A | 8/1983 | Bose |
| 4,415,275 | A | 11/1983 | Dietrich |
| 4,464,314 | A | 8/1984 | Surovikin et al. |
| 4,553,504 | A | 11/1985 | Duggal et al. |
| 4,812,049 | A | 3/1989 | McCall |
| 4,917,152 | A | 4/1990 | Decker |
| 4,954,147 | A | 9/1990 | Gaigon |
| 5,174,247 | A | 12/1992 | Tosa et al. |
| 5,176,448 | A | 1/1993 | King et al. |
| 5,183,335 | A | 2/1993 | Lang et al. |
| 5,193,341 | A | 3/1993 | Sibbertsen et al. |
| 5,330,105 | A | 7/1994 | Kaylor |
| 5,372,281 | A | 12/1994 | Palmer et al. |
| 5,449,114 | A | 9/1995 | Wells et al. |
| 5,452,955 | A | 9/1995 | Lundstrom |
| 5,460,449 | A | 10/1995 | Kent et al. |
| 5,492,404 | A | 2/1996 | Smith |
| 5,492,409 | A | 2/1996 | Karlsson et al. |
| 5,575,561 | A | 11/1996 | Rohwer |
| 5,657,631 | A | 8/1997 | Androsov |
| 5,678,766 | A | 10/1997 | Peck et al. |
| 5,820,256 | A | 10/1998 | Morrison |
| 5,865,158 | A | 2/1999 | Cleveland et al. |
| 5,918,465 | A | 7/1999 | Schmid |
| 5,992,529 | A | 11/1999 | Williams |
| 6,022,135 | A | 2/2000 | Williams |
| 6,027,241 | A | 2/2000 | King |
| 6,036,356 | A | 3/2000 | Yang et al. |
| RE36,969 | E | 11/2000 | Streiff et al. |
| 6,170,978 | B1 | 1/2001 | Short |
| 6,367,262 | B1 | 4/2002 | Mongia et al. |
| 6,422,735 | B1 | 7/2002 | Lang |
| 6,432,148 | B1 | 8/2002 | Ganan-Calvo |
| 6,534,023 | B1 | 3/2003 | Liou |
| 6,669,843 | B2 | 12/2003 | Arnaud |
| 6,974,542 | B2 | 12/2005 | von Phul |
| 6,986,832 | B2 | 1/2006 | Lamminen et al. |
| 7,018,435 | B1 | 3/2006 | Wentinck |
| 7,041,144 | B2 | 5/2006 | Kozyuk |
| 7,165,881 | B2 | 1/2007 | Holl |
| 7,448,794 | B2 | 11/2008 | Hansen |
| 2006/0150643 | A1 | 7/2006 | Sullivan |
| 2007/0137590 | A1 | 6/2007 | Vetrovec |
| 2007/0206435 | A1 | 9/2007 | Lester et al. |
| 2008/0016968 | A1 | 1/2008 | McCall et al. |
| 2008/0194868 | A1 | 8/2008 | Kozyuk |

FOREIGN PATENT DOCUMENTS

| | | |
|---|---|---|
| DE | 29612769 | 12/1996 |
| DE | 10310442 | 9/2004 |
| EP | 0044498 | 1/1982 |
| GB | 0853502 | 11/1959 |
| GB | 2263649 | 8/1993 |
| GB | 2334901 | 9/1999 |
| JP | 56130213 | 10/1981 |
| JP | 62079835 | 4/1987 |
| JP | 5161899 | 6/1993 |
| JP | 8131800 | 5/1996 |
| JP | 2001000849 | 1/2001 |
| JP | 2006326498 | 12/2006 |
| KR | 20040040926 | 5/2004 |
| RU | 2133829 | 7/1999 |
| SU | 1662653 | 7/1991 |
| WO | WO88/06493 | 9/1988 |
| WO | WO93/07960 | 4/1993 |
| WO | WO00/12202 | 3/2000 |
| WO | WO2006/038810 | 4/2006 |
| WO | WO2006/117435 | 11/2006 |
| WO | WO2007/086897 | 8/2007 |
| WO | WO2007/115810 | 10/2007 |
| WO | WO2009/021148 | 2/2009 |
| WO | WO2009/035334 | 3/2009 |

OTHER PUBLICATIONS

Written Opinion for International Application No. PCT/US2008/75366, Nov. 13, 2008, 5 pp.

International Search Report for International Application No. PCT/US2008/75374, Mar. 23, 2008, 4 pp.

Written Opinion for International Application No. PCT/US2008/75374, Mar. 23, 2008, 8 pp.

International Search Report for International Application No. PCT/US2008/75378, Nov. 18, 2008, 2 pp.

Written Opinion for International Application No. PCT/US2008/75378, Nov. 18, 2008, 5 pp.

International Search Report for International Application No. PCT/US2009/43547, Jul. 9, 2009, 2 pp.

Written Opinion for International Application No. PCT/US2009/43547, Jul. 9, 2009, 9 pp.

* cited by examiner

FLUID COMPOSITE, DEVICE FOR PRODUCING THEREOF AND SYSTEM OF USE

CLAIMS OF PRIORITY

This application is a Continuation-in-Part of U.S. patent application Ser. No. 12/529,625, filed on Apr. 15, 2010, which is the national stage filing of International Patent App. No. PCT/US08/75374 and claims priority to U.S. Provisional App. No. 60/970,655, filed on Sep. 7, 2007, U.S. Provisional App. No. 60/974,909, filed on Sep. 25, 2007, U.S. Provisional App. No. 60/978,932, filed on Oct. 10, 2007, U.S. Provisional App. No. 61/012,334, filed on Dec. 7, 2007, U.S. Provisional App. No. 61/012,337, filed on Dec. 7, 2007, U.S. Provisional App. No. 61/012,340, filed on Dec. 7, 2007, and U.S. Provisional App. No. 61/037,032, filed on Mar. 17, 2008.

This application further claims priority to U.S. patent application Ser. No. 12/529,617, filed Sep. 2, 2009, which is the national stage filing of International Patent App. No. PCT/US08/075366, and claims priority to U.S. Provisional App. No. 60/970,655, filed on Sep. 7, 2007, U.S. Provisional App. No. 60/974,909, filed on Sep. 25, 2007, U.S. Provisional App. No. 60/978,932, filed on Oct. 10, 2007, U.S. Provisional App. No. 61/012,334, filed on Dec. 7, 2007, U.S. Provisional App. No. 61/012,337, filed on Dec. 7, 2007, U.S. Provisional App. No. 61/012,340, filed on Dec. 7, 2007, and U.S. Provisional App. No. 61/037,032, filed on Mar. 17, 2008. All the preceding applications are incorporated by reference in their entirety.

FIELD OF THE INVENTION

The invention relates to a fluid composite, a device for producing the fluid composite, and a system for producing an aerated fluid composite therewith, and more specifically a fluid composite made of a fuel and its oxidant for burning as part of different systems such as fuel burners or combustion chambers and the like.

BACKGROUND

Mixing of components is known. The basic criterion for defining efficiency of a mixing process relates to those parameters that define the uniformity of a resultant mix, the needed energy to create this change in parameters, and the capacity of the mix to maintain those different new conditions. In some technologies, such as the combustion of a biofuel, an organic fuel, or any other exothermic combustible element, there is a desire for an improved method of mixing a combustible element with its oxidant or with other useful fluids as part of the combustion process.

Several technologies are known to help with the combustion of fuel, such as nozzles that spray a fuel within the oxidant using pressurized air, eductors, atomizers, or venturi devices that are sometimes more effective than mechanical mixing devices, these devices generally act upon only one components to be mixed (i.e. the fuel or the oxidant) to recreate a dynamic condition and an increase of kinetic energy. Engines such as internal combustion engines burn fuel to power a mechanical device. In all cases, these engines exhibit less than one hundred percent efficiency in burning the fuel. The inefficiencies result in a portion of the fuel remaining non-combusted after a fuel cycle, the creation of soot, or the burning at less than optimal rates. The inefficiency of engines or combustion chamber conditions can result in increased toxic emissions into the atmosphere and can require a larger amount of fuel to generate a selected level of energy. Various processes have been used to attempt to increase the efficiency of combustion.

In chemistry, a mixture results from the mix of two or more different substances without chemical bonding or chemical alteration. The molecules of two or more different substances, in fluid or gaseous form, are mixed to form a solution. Mixtures are the product of blending, mixing, of substances like elements and compounds, without chemical bonding or other chemical change, so that each substance retains its own chemical properties and makeup. Composites can be the mixture of two or more fluids, liquids, or gas or any combination thereof. For example a fluid composite may be created from a mixture of a fossil fuel and its oxidant such as air. While one type of composite is described, one of ordinary skill in the art will recognize that any type of composite is contemplated.

Another property of composites is the change in overall properties while each of the constituting substances retains their own properties when measures locally. For example, the boiling temperature of a composite may be the average boiling temperature of the different substances forming the composite. Some composite mixtures are homogenous, while other are heterogeneous. A homogenous composite is a mixture whose composition locally cannot be identified, while a heterogenous mixture is a mixture with a composition that can easily be identified since there are two or more phases present.

What is needed is a new fluid composite having desirable overall properties and characteristics, and more specifically a new fuel composite with improved property of enhance fuel burning, burn rates, greater heat production from the fuel, better spread of the thermal distribution in an environment, and other such properties. Further, fuel is often sent to a combustion chamber using a pump, since fuel is a liquid it is mostly incompressible. Compressibility allows for compression and expansion and is often desirable. Further, incompressible fluids are subject to great changes in internal pressure when flow is disrupted or pumping is not uniform. What is needed is a fluid composite capable of giving compressibility to a fuel without the disadvantages associated with compressible gases.

SUMMARY

The current disclosure relates to a new fluid composite, a device for producing the fluid composite, and a system of use therewith, and more specifically a fluid composite made of a fuel and its oxidant for burning as part of different systems such as fuel burners, where the fluid composite after a stage of intense molecular between a controlled flow of a liquid such as fuel and a faster flow of compressed highly directional gas such as air results in the creation of a three dimensional matrix of small hallow spheres each made of a layer of fuel around a volume of pressurized gas. Since the fuel composite is compressible, external conditions such as inline pressure can warp the spherical cells into a network of oblong shape cells where pressurized air is used as part of the combustion process. In yet another embodiment, additional gas such as air is added via a second inlet to increase the proportion of oxidant to carburant as part of the mixture.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION

Figure 1:
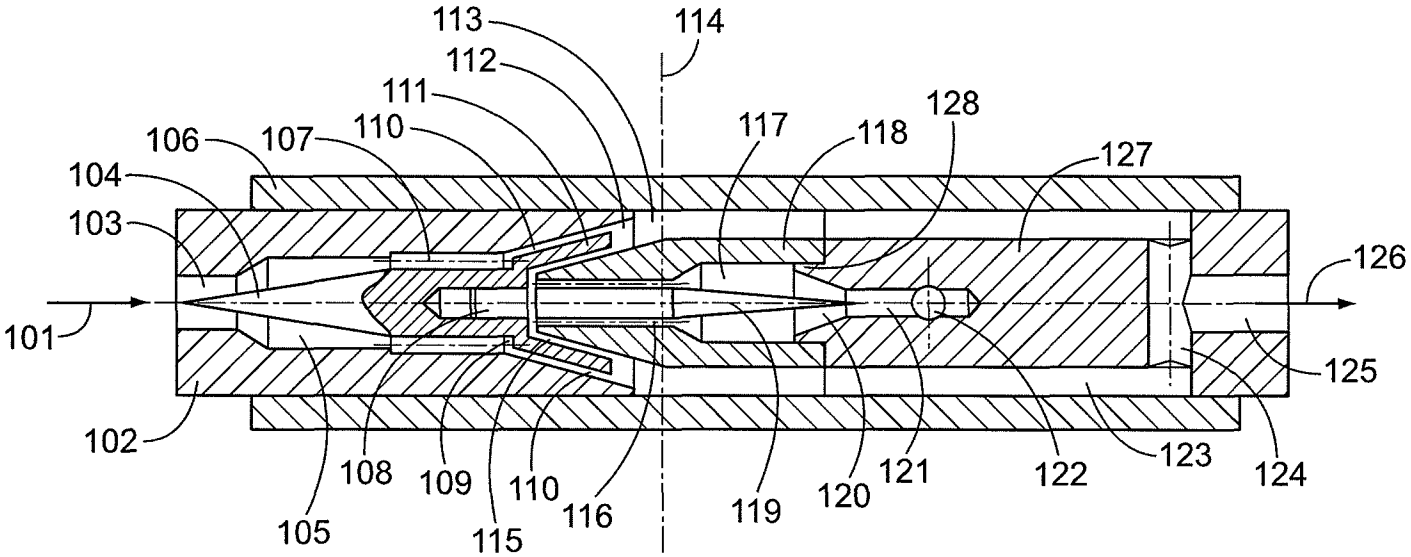
FIG. 1 is a cross-section of a device for producing a fluid composite.

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one skilled in the art to which this disclosure relates.

The following specification includes by reference all figures, disclosure, claims, headers, titles, of International Applications Nos. PCT/US08/75374, filed Sep. 5, 2008, and entitled "Dynamic Mixing of Fluids", and PCT/US08/075366, also filed on Sep. 5, 2008, and entitled "Method of Dynamic Mixing of Fluids" along with nationalized U.S. applications Ser. No. 12/529,625, filed Sep. 2, 2009, and entitled "Dynamic Mixing of Fluids", and Ser. No. 12/529,617, filed Sep. 2, 2009, and entitled "Method of Dynamic Mixing of Fluids."

Figure 9:
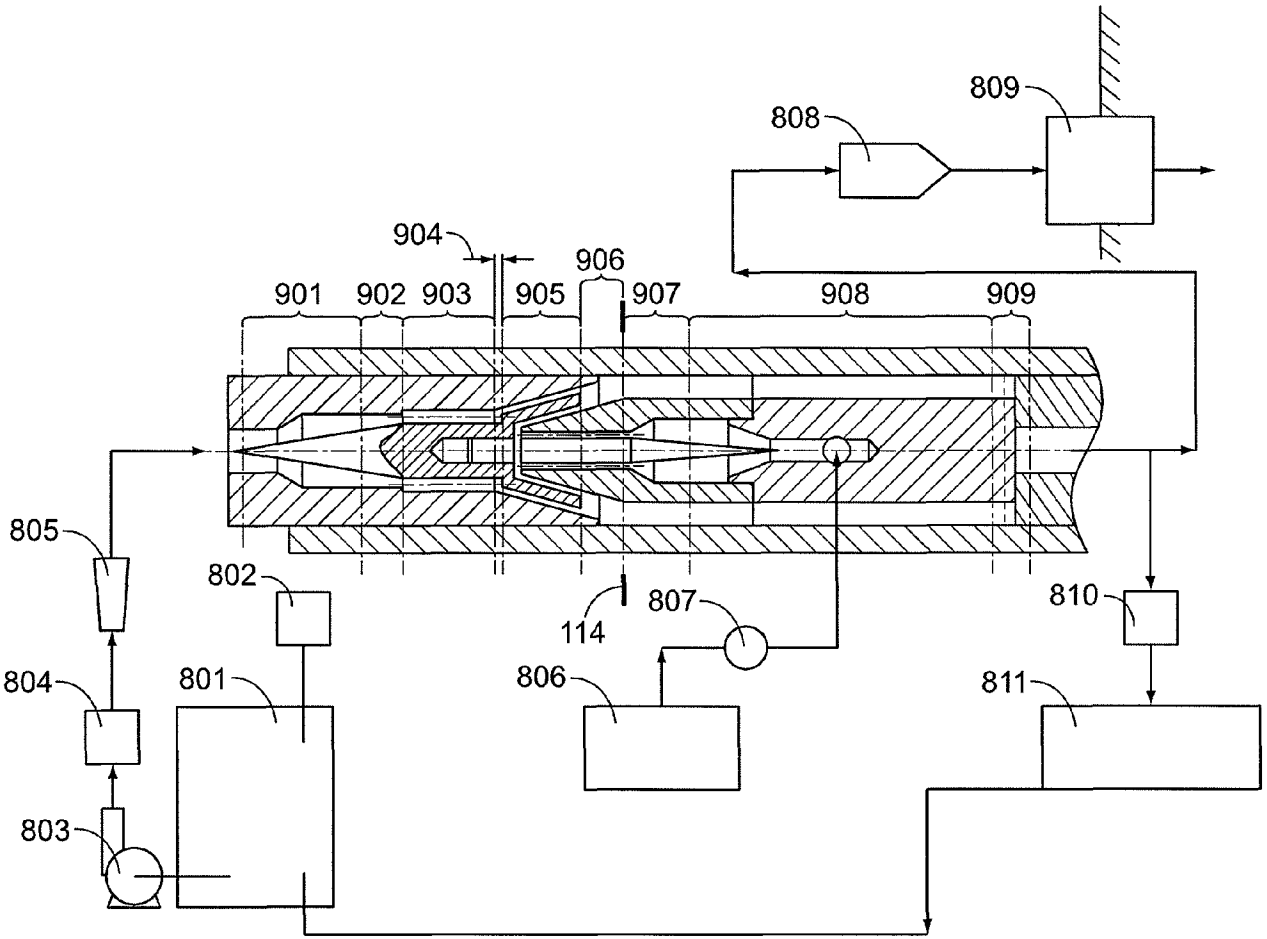
FIG. 9 illustrates the different phases of dynamic evolution of the process of formation of the fluid composite according to the device shown at FIG. 1 according to an embodiment of the present disclosure.
Figure 13A:
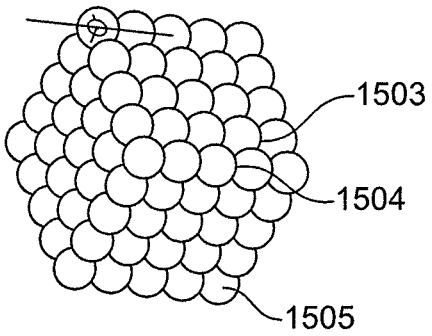
FIGS. 13A-13D are diagrams of fuel from the parent application given as FIGS. 15A to 15D.
Figure 13B:
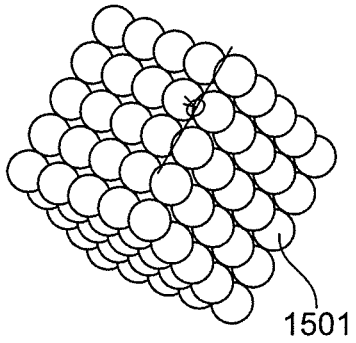
Figure 13C:
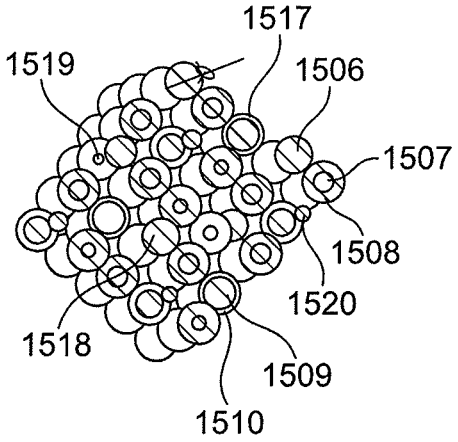
Figure 13D:
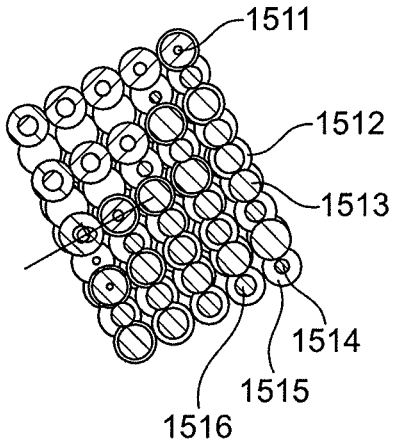

The parent application shows as what was previously FIGS. 15A to 15D. FIG. 13A shows the volumetric structure after the first stage of activation, when the volume made of foam bubbles have not started to be transformed in space of the fuel pipeline and are as though pressed to each other. FIG. 13B shows the structure when the bubbles are being transformed in the fuel mix and separate from each other. FIGS. 13C and 13D show the internal processes in the activated volume of a fuel mix as it moves in the fuel pipeline. This process shows how volumetrically, small spheres are formed and how as the pressure of the gas inside of the sphere changes, the thickness of the fuel shell thins. This process as illustrated is found at zones 906 to 909 as shown at FIG. 9, greater detail is provided below.

In general, as shown at FIGS. 2A-D, micro-bubbles of fluid are formed and include a core of compressed gas 201 surrounded by a shell of liquid such as fluid or fuel 202 or a shell made of fuel mixed with another liquid such as water. A new foam-like composite called herein the fluid composite 1 is formed including a very large number of very small cells 200 each with a very large number of very small compressed gas cores 201. The cells are small and numerous and are formed as part of the fluid composite 1 in a very high energy state with dynamic and kinetic energy. The whitish foam of micro-bubbles 200 also called the fluid composite 1, the fluid and the gas are energized and dynamic. While this disclosure is directed to the creation of any fluid composite 1 made of imbedded pressurized compressed gas 201 core over a shell 202, having different dynamic components, in one embodiment, the composite is a fuel composite 1 where the liquid is fuel and the gas is air needed to burn the fuel. Within this disclosure, while the term fluid composite 1 is used, one of ordinary skill in the art will understand that the composite 1 can be made of any liquid or liquids mixed in with gas for any commercial application. As a way of a non limiting example, water for irrigation and plant nourishment can require aeration to help with seeping and plant absorption. The water may also require mixing with a fraction portion of fertilizer.

In a fluid composite 1 example, the creation and the merger of a fixed fraction of gas into the liquid is based on a stoichiometric ratio of air to fuel exists where burning is optimal. For some applications, a fraction of this air may be imbedded into the fluid composite 1 to enhance the properties of the fuel. In one example, 10%, 20%, or even 30% of stoichiometric air in weight can be merged into the fuel as part of the fluid composite 1. The density of air at ground level is approximately $\rho_{air}$=0.0012 kg/l while the density of gasoline is approximately $\rho_{gz}$=0.703 kg/l and diesel $\rho_{dz}$=0.85 kg/l.

With a stoichiometric ratio for diesel fuel to air of 14.6 to 1 and for gasoline of 14.7 to 1, the ratios at the above suggested gas to liquid ratio will vary from about 1.47 to 1 (e.g. 10% or 14.7 to 1) to 4.38 to 1 (e.g. 30% of 14.7 to 1). For the ratio to be 10%, a quantity of 0.085 kg/l must be inserted, or approximately 70.3 liters of air per liter of fuel. At a level of 20% in weight of air, 140.6 liters of air must be mixed in the fuel, and at 30% a quantity of 210.9 liters of air must be inserted into 1 liter of fuel. These values are only illustrative of possible ratios and other ratios are contemplated within the acceptable parameters of the fluid composite 1.

At these volumetric ratios, for every 1 liter of fuel, 70.3 to 210.9 liters of air are mixed in the fluid composite 1. Since the fluid composite 1 is a pressurized medium, and that only the gas portion of the fuel cells 200 is compressible (at pressures below 1000 bars), a fluid composite at 17 bars of pressure and a ratio of a 10% mix will correspond to a volume of gas of 4.14 liters of pressurized gas cells 201 inside of a volume of 1 liter of fuel (i.e. 70.3 liters/17 bars). While some ratios are given, what is contemplated is the merger of any ratio of air into the fluid composite either at initial stages of formation or at a second stage after the first fluid composite has been prepared.

The size of the micro-bubbles can also vary based on a plurality of characteristics and components of the apparatus for the creation of the fluid composite 1 as shown at FIG. 1. Fluid viscosity, surface tension, the temperature, the speed, the pressure, to kinetic energy, are only a small fraction of the different parameters that play a role into the determination and control of a created by a device with small channels 115 where gas flows of a thickness of 5 to 50 μm. Small bubbles of a diameter of 5 to 50 μm are created as shown on FIGS. 1, and 2D. Once again, the size of these channels 115 is only illustrative of one contemplated embodiment, for one type of fluid to create one type of fluid composite 1 with unique properties.

These sizes of bubbles 201 correspond for example to an internal radius ($r_g$) of small spheres of 2.5 microns 25 microns. The absolute volume of gas ($V_g$) is given by $V_g$=P*(4/3)$\pi r_g^3$ where P is the pressure inside the sphere. $V_g$ can be calculated to be in a range for channels 115 of 5 to 50 μm from $V_g$=65.5*P to 65,500*P $\mu m^3$. In a network structure where cells are arranged as shown in the configuration of FIG. 2B, the volume of fuel ($V_f$) in the shell surrounding a single bubble is $V_f$=(4/3)$\pi r_f^3$−$V_g$/P where $r_f$ is the radius of the sphere of liquid and $V_g$ is the volume of a sphere of gas. As shown on FIG. 2B, in one embodiment, the shell of the bubbles have a thickness in proportion with the thickness of gas inside the bubble (i.e. where $r_f$~$2r_g$). In such a sample case, $V_f$=1151 to 524,000 $\mu m^3$. While one ratio of thickness of the fuel 202 over the size of the gas 201 is shown and used to help described the fluid composite 1, one of ordinary skill in the art will understand that fluid composites 1 can be produced having a very wide range of geometries based on the evolution, calibration, of different properties, such as the ratio of the flow rate of incoming gas to the flow rate of incoming liquid, the ratio of volume at the different phases alongside the device shown at FIG. 1, etc.

Returning to the above example, in order to obtain stoichiometric gas to liquid ratio of 10%, i.e. a fluid composite having a volume of gas of 4.14 liters the volume of liquid over the volume of fuel is taken to be $V_g/V_f$=4.14 where for example a 5 μm gas bubble is used, a pressure of 17 bars=Vf*4.14/Vg so a ratio of 1151*4.14/65.5=4.10 is calculated. With a fixed internal bubble of 5 μm, with a reverse calculation we can determine volume of fluid of 268.5 $\mu m^3$ and thus determine a radius for the external shell of fuel of 9.75 μm.

Within the confines of testing, in one embodiment, at a stoichiometric air to fuel ratio of 10%, the pressure of the fluid composite is 17 bars for an air entry of 45 bars, for a ratio of 20%, the pressure rises to 35 bars, and for a ratio of 30% the pressure becomes 50 bars for the same air entry pressure. This calculation is a sample calculation and one of ordinary skill in the art will recognize that the thickness of the outer shell of liquid may vary based on a plurality of static and dynamic conditions created within the device as shown at FIG. 1.

A volume of 1 liter of fluid represents a volume $1\times10^{15}$ μm3 which can contain up to $1.8\times10^9$ cells of a volume of $5.24\times10^5$ cubic micrometers. The inventor has calculated that in one embodiment, the fluid composite had a density of approximately $2.7\times10^7$ cells/l. While FIG. 2B teaches a fluid composite where each cell 200 touches the adjacent cell, the fluid composite 1 remains a fluid composite even if the density of cells within the composite drops. For example, the inventor has determined that at density concentrations of 1.5% of the maximum cell density, the fluid composite 1 remains a fluid composite and the associated properties.

Further, in order for the micro-bubble to remain stable for a length of time prior to entry of the micro-bubble into a combustion chamber, the shell of the liquid surrounding the compressed gas is thick enough to prevent the micro-bubble from bursting. In a dynamic mixture, the energy stored within the composite fluid in the form of Brownian movement must first be reduced greatly before the bubbles can collapse. In a regular flow, the fluid molecules in the static walls around pockets of gas thins down as the fluid migrates down under the force of gravity. The walls thin up to a value equivalent to the surface tension forces within the liquid. In a stable flow made of micro-bubbles, an equilibrium must be such that surface tension forces of the liquid shell of a bubble is sufficient to prevent a bubble to collapse with an adjacent bubble having similar properties. Small liquid droplets such as the micro-bubbles are describes and defined by the Young-Laplace equation:

$$\Delta P = \gamma\left(\frac{1}{R_x} + \frac{1}{R_y}\right)$$

Where γ is the surface tension of the external liquid shell of a bubble, $R_x$ and $R_y$ are curvature radius in X and Y axis respectively, and ΔP is the pressure difference in bars between the internal and the external of the bubble. For the interface water/air at room temperature, γ is approximately 73 mN/m. For an interface between most fuel/air the surface tension is in the range of γ=20 to 40 nM/m. For the micro-bubbles to maintain coherent in a network of cells as shown on FIGS. 13A to 13D, the pressure variation between the inside portion of the bubble and the outside must be coherent.

For droplets of water at standard room temperature and pressure, internal pressure of the bubble cannot rise above 0.0014 bar for a bubble of 1 mm in radius, 0.0144 bar for a bubble of 100 μm, 1.43 bar for a bubble of 1 μm in radius, and 143 bar for a bubble of 10 ηm in radius. In the above example where the surface tension fuel/air is approximately half of the surface tension as the water/air figure, these values are taken to be half of the listed values. These values do not take into effect that the bubbles operate in a fixed volume of incompressible liquid. In a fixed volume area such as the area within a pipe, the effect of small bubble walls collapsing into a single larger bubble, thus breaking the fluid composite would result in a reduction of the surface between the liquid and the gas, an increase in the compactness of the liquid, and thus a diminution of the internal pressure of the gas.

At equilibrium, the fluid composite is in a state where surface tension is such that the pressure difference between the inside of the bubbles when compared to the pressure inside the incompressible fluid acting on the outside of the bubbles is inferior to the Young-Laplace value. At these values, the collapse of a bubble no longer results in a negative value of the Gibbs free energy per unit area.

Figure 2A:
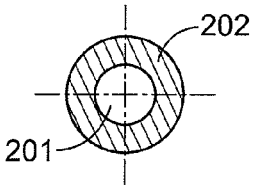
FIG. 2A is diagram of a fuel cell as part of the fluid composite produced by the device shown at FIG. 1 according to an embodiment of the present disclosure.
Figure 2B:
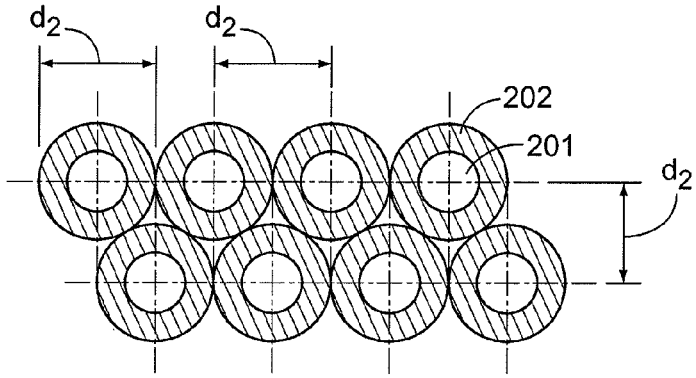
FIG. 2B is two dimensional representation of a network of fuel cells as shown at FIG. 2A as part of the fluid composite produced using the device shown at FIG. 1 according to an embodiment of the present disclosure.
Figure 2C:
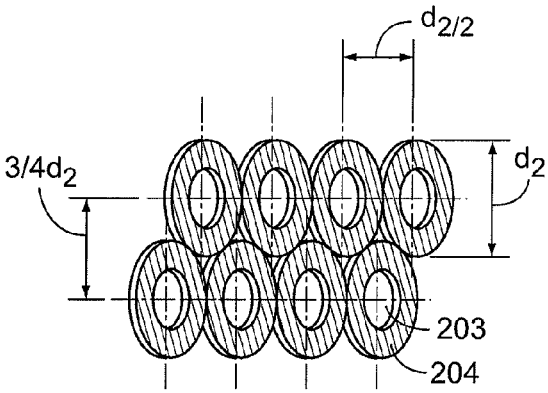
FIG. 2C is a close us view of an expansion area for the first and second fluids where cells of the fluid composite as shown at FIG. 2B are produced within the device for producing a fluid composite as shown on FIG. 1 according to an embodiment of the present disclosure.

FIG. 2A shows a gaseous compressed kernel or cell 200 of a fluid composite 1 as shown on FIG. 2B. Each cell 200 as shown includes a compressed gas center 201 surrounded by a shell of incompressible liquid 202. Shells are held in shape under the external pressure of the fluid composite 1 and in situations where the pressure is uniform in the fluid composite, the structure of the cell 200 is spherical. d2 illustrates both the external diameter of the liquid cell 200 and the distance between centers of adjacent fuel cells 200. FIG. 2C illustrates a situation where pressure in the fluid composite 1 is not uniform. The illustration is of a slice in thickness of oval shape cells 200 where the distance in one direction remains d2, but is compressed in the other direction to ½ of d2. In this context, the distance between centers of two adjacent cells is only ¾ of d2. Pressure as shown on FIG. 2C is greater in the horizontal axis by a factor of 2. In one contemplated embodiment, the pressure is caused by external sources such as the pressure of the fluid entering the fluid composite device as shown on FIG. 1 and the like. The fluid composite 1 as shown, unlike the liquid, is compressible in part. The partly compressible nature the fluid composite allows for the composite to evolve past structures of variable geometries and expand/contact locally in yet another advantageous property of the fluid composite 1.

Figure 2D:
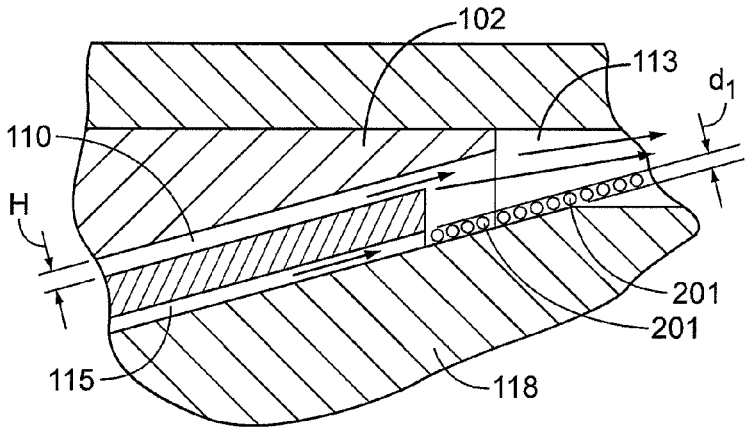
FIG. 2D is a two dimensional representation of the network of fuel cells as shown at FIG. 2B as part of a compressed fluid composite produced using the device shown at FIG. 1 according to an embodiment of the present disclosure.
Figure 12:
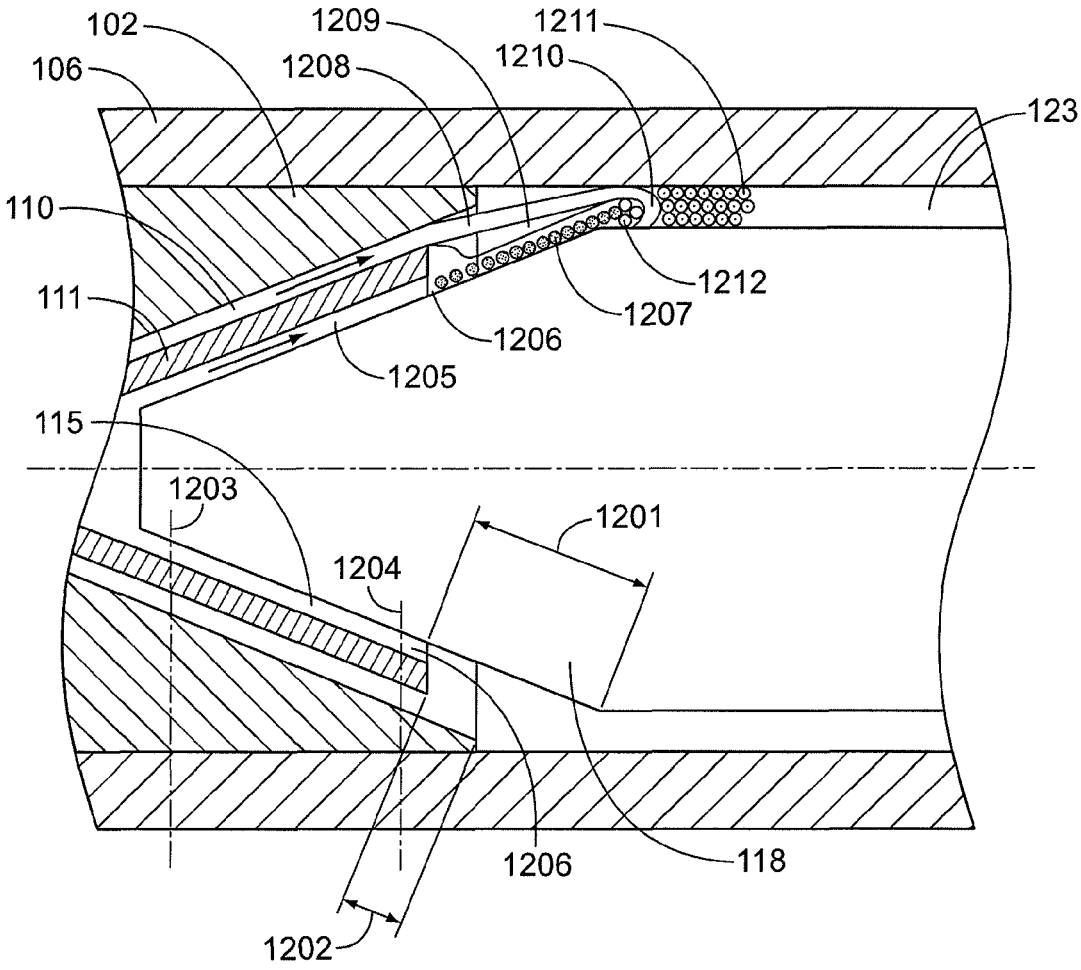
FIG. 12 illustrates with greater detail the mechanism of formation of the fluid composite as illustrated at FIG. 2D.

FIG. 2D shows a portion of the device for the production of the fluid composite 1 as shown at FIG. 1 where the gaseous fuel cells 201 are dynamically being created. FIG. 12 shows an illustration to help understand the interface where the gas cells 201 connect with the activated liquid or gasified liquid portion. Returning to FIG. 2D, air is accelerated and split into small linear cannels 115. The gas as shown is pushed at a speed where it becomes fully turbulent. In addition to molecular movement and linear average displacement of the gas molecules, small vortices structures are created in the flow creating small circulating structure within the gas at the area of release as shown. These vortices have the pressure of the gas within the channel 115 and store dynamic and kinetic energy in surplus of linear kinetic energy. The molecules of gas arrange in what is described as a dynamic evolution. In one embodiment, the dynamic evolution is a series of vortices where the gas is arranged in structures with rotational energy. Other structures and movements of the gas is contemplated as part of the dynamic evolution.

Once gas as part of these structures leave the channels 115, they have strong dynamic and turbulent activity. Their coherent structure has a average diameter of d1 shown to be the diameter of the channel 115 corrected by the depression ratio created within a ring channel 113. The illustration shows in a simplified fashion how the vortices align along the wall and move up in the ring channel 113 but this alignment is shown for illustration purposes only, the cells 201 already with turbulent movement move in this area in a turbulent fashion under a high rate of speed that is equal to the flow of speed of the fluid composite 1 in the device. The distance between the two coaxial reflectors between the hydraulic and the pneumatic sections 110 is shown with a thickness of H creating a turbulent fluid flow of thickness H. In one embodiment, the thickness H is in the range of 5 to 100 microns, in another embodiment, H is in the range of 10 to 50 microns but thicker ranges such as 100 to 500 microns or even greater are also contemplated. The liquid accelerated and having highly turbulent and dynamic velocity is then projected into the ring channel 113 area where it expands in the increased volume.

FIG. 12 shows how the fluid 1208 may expand to encompass the entire area 1209 considered to be a local ring zone between a hydro-dynamical area and the aerodynamic area where both streams 110, 115 travel. The pressure varies within the area 1209 and as a consequence, vortex bubbles are created at 1206 and travel upwards to a zone of settled low pressure and high linear speed 1207 before entering a zone 1212 of low pressure and linear movement where the streams merge to form the fluid composite 1 and settles into a channel 123. The fluid when released at 1208, is turbulent and dynamic.

At 1210, an elastic resistance wave is shown where compressed cells 1212 connect with the fluid 110 to create a network of fast moving cells as part of the fluid composite 1 as shown with greater detail at FIGS. 2A-C. One of ordinary skill in the art will understand that while a regular array of cells is shown, each with a gas center 201 surrounded by a shell of incompressible liquid 202, the energy poured into the creation of the fluid composite 1 is greater and much of the energy remains stored as dynamic elements within the fluid composite 1. For example, the different cells 1211 shown on FIG. 12 have relative movement and translate, move and shake as would molecules based on a Brownian movement. The gas within the gas center 201 also retains kinetic and dynamic energy, and the fluid also moves turbulently between the pockets of compressed gas.

In an embodiment, the energy is sufficient to help dilute a large fraction of gas molecules, such as gas of nitrogen from the air into the fluid. In another embodiment, the energy is sufficient to break chemical bonds in water and in air and create chemical radicals that can reattach in a plurality of useful ways. For example, if the fluid and the gas are at different temperatures, the resulting mixture may be at the average temperature of the input fluids but a higher energy fluid can be used to help promote nitrogen dilution, chemical reactions, or even cracking of the water for hydrogen ion production.

What is shown and described is a pressurized fluid composite 1 within a vessel such as an external case 106 shown in one embodiment as a portion of a cylindrical pipe. In one embodiment, the external case 106 is a pipe of uniform diameter. Fluid as shown on FIG. 1 enters at 101 and the fluid composite 1 exits at 126 as the stabilized fluid composite 1 on the right of the device. The fluid composite 1 is made of a network of fuel cells 200 in dynamic contact with each other as shown at FIG. 2B or even FIG. 12. The structure includes a plurality of fuel spheres or fuel cells 200 each multilevel fuel sphere including a core of compressed gas 201 in dynamic evolution, and a shell 202 surrounding the core of compressed gas 201 made of a liquid in dynamic movement. The dynamic contact of fuel cells shown as a neatly packed array of cells 200 is a turbulent displacement of adjacent and connecting cells 200 in a three dimensional environment moving in relation to each other. The dynamic movement of the liquid of the shell 202 of each cell 200 is a turbulent movement of liquid molecules within the thickness of the shell 202, and the dynamic evolution of the compressed gas 201 is a turbulent movement with vortices.

Within the scope of this disclosure, the term dynamic as part of the expression dynamic contact, dynamic movement, dynamic evolution, or any other expression is to be read and understood as an open handed word to include in addition to any ordinary meaning the fact the different molecules, particles, and constituents of a fluid or gas have a higher level of energy and that as a consequence the molecular agitation, either in term of the linear velocity, angular velocity, spin, Brownian movement, or even temperature are greater than a non dynamic state in contrast to a static state that is non dynamic. The term dynamic include kinetic energy, positive enthalpy changes, positive entropy changes, etc.

In another embodiment, the turbulent displacement is a Brownian movement, a movement that seemingly appears random but is a continuous-time stochastic process. In another embodiment, the fluid composite 1 is made of an incompressible liquid such as a hydrocarbon based fuel and the gas is compressed air. A ratio of the volume of the core of compressed gas over the volume of the fuel cells is 10% to 30% of the stoichiometric air, or a ratio of 1.47 to 4.38 to 1 where stoichiometric ratio is 14.7 of air over fuel and 10% is 1.47 time the volume of air to fuel.

FIG. 1 shows a device 100 for the production of a fluid composite 1. This device is explained partly in U.S. under applications Ser. No. 12/529,625, filed Sep. 2, 2009, and entitled "Dynamic Mixing of Fluids", and Ser. No. 12/529,617, filed Sep. 2, 2009, and entitled "Method of Dynamic Mixing of Fluids" both applications are incorporated by reference in their entirety. This device 100 is shown with a plurality of different embodiments at FIGS. 3 to 7, and is shown as part of a system for the production of a fluid composite at FIGS. 8 to 11. This device 1 is used to conduct the dynamic mixing and the production of a fluid composite 1 for a plurality of uses including but not limited to the injection of aerated and compressed fuel into an injection chamber of a combustion cycle.

The gas serving as the oxide must be brought in immediate contact with the fuel for optimum combustion of the fuel. When compressed gas 201 as shown on FIG. 2 is released into a non-compressed area, such as a combustion chamber or any other opened area, the gas will immediately expand to reach atmospheric pressure by increasing in size in proportion with its pressure. The external shell 202 under the expansion force, will rip apart the fuel and create a very uniform mist of fuel where combustion is enhanced. High efficiency in fuel burning corresponds to high efficiency in burning of thermal equipment. In a diesel type fuel, greater burning and cleaner burning rates can result from using the composite fuel 1.

A larger quantity of compressed air, up to 20 times more can be used as carburant of the diesel fuel. The volume of the fluid composite 1 can be increased several times fold, for example the volume of gas reaches for diesel up to 20 times the volume of fuel. Pressure can also be increased during the process of aeration or formation of the fluid composite 1 by adding pressurized gas to an already pressurized inlet of liquid. In one embodiment, the linear speed of the composite fuel 126 over the arrival fuel 101 as shown on FIG. 1 can be up to 20 to 1 or a proportion of the aeration ratio. Pressure can be increased up to five times, the output flame created by the release of the composite fuel 1 in an open area can be increased multiple times because of the added pressure and internal expansion. In one embodiment, an increase in length of a torch in a flame in a burner of 3× is measured. The volume of flame of the fuel is also increased with the same proportion. As a result of greater and cleaner combustion using the fluid composite 1 over ordinary fuel and the lesser the release of waste such as $NO_x$, CO, $CO_2$, and soot particles.

The fluid composite 1 is a fuel with new properties. Adding gas does more than create a dual state mixture. The fluid composite 1 has a new physical structure, a new dynamic state that is compressible, can be expanded, may be further merged with other sources of gas or liquids, and results in a fuel with different performance and properties. The fluid composite 1 has increased thermal efficiency, increased burning capacity, reduction of the specific charge of the fuel. Further, as part of the process of creation of the fluid composite 1, gas is added and the volume and resulting speed of the fluid composite 1 is increased. The fluid composite 1 is a three-dimensional mixture made of a mixture of components in dynamic movement. The nature of the fluid composite 1 allows for an easier flow thought variable geometry designs cause by the compressible/expansive nature of the composite 1. In another embodiment, water is added to the fluid composite to enhance hydrocarbon burning as known in the art. Further, the compressed gas will serve to propel the fluid composite 1 out of the nozzle head.

Once the fluid composite 1 is formed, the mass ratio of gas over liquid is fixed and does not change until the fluid composite 1 is finally expanded at a point of combustion, if it is expanded into an open volume with gas or liquid present; for example in a burning chamber of a burner or the piston of a diesel engine. Since the gas is compressible and the liquid is generally not compressible, as the pressure varies, the volumetric ratio unlike the mass ratio changes.

As for any composite 1, such as diesel fluid composite, or any other composite, a compressibility limit exists. In an ordinary liquid, when a pressure change enters the medium, the liquid does not significantly change in volume. In an ordinary gas the medium is compressible and as the pressure changes in proportion with the pressure change (e.g. PV=NRT). For example, an increase by 100% of the pressure results in a decrease of half of the volume of the gas.

In the fluid composite, as the pressure changes, the liquid remains incompressible but the small spheres of gas 201 are compressible and will change in volume based on the evolution of volume of a sphere. For the above increase of the pressure by 100%, the volume of gas of a sphere $V_g=(4/3)\pi r_g^3$ must be halved so the pressure inside of a small gas bubble doubles. A sphere of gas 201 of diameter 50 μm and a radius of $r_g$=25 μm ($V_g$=65,500 $\mu m^3$) will increase in pressure twofold once the volume is halved (here to 32,750 $\mu m^3$). The new radius of the gas sphere 201 associated with this volume is $r_g$=~20 μm.

As the gas spheres grow smaller, understandably their capacity to shrink under pressure will reduce. The fluid composite 1 evolves when a large fraction of gas is present in the composite 1 from a gas like composite and morphs into and acts more like an incompressible liquid once the volumetric fraction of gas decreases. In the above example, if the composite is viewed in two dimensional, the gas proportion will evolve from an initial gas surface of $S_1$=1964 $\mu m^2=\pi r_1^2$ to a final gas surface of $S_2$=1256 $\mu m^2=\pi r_1^2$. So the change in surface of the volume is $S_2/S_1$=1256/1964=0.64 or 64% for a decrease of the volume of the spheres of 50%. As the fluid composite 1 has a ratio of gas to liquid that closure to a liquid, this proportion changes accordingly. The fluid composite 1 has evolving unique properties based on partially and evolving compressible nature. Other properties such as latent heat, thermal capacity, specific heat, also evolve as a fluid composite 1 and not as two individual mixed elements. What is described and understood as the composite is a material, that includes a very large quantity of small volumes having different characteristics that result in creating an overall material called the composite 1 with characteristics and properties that different from a sum of its constituents.

Figure 3:
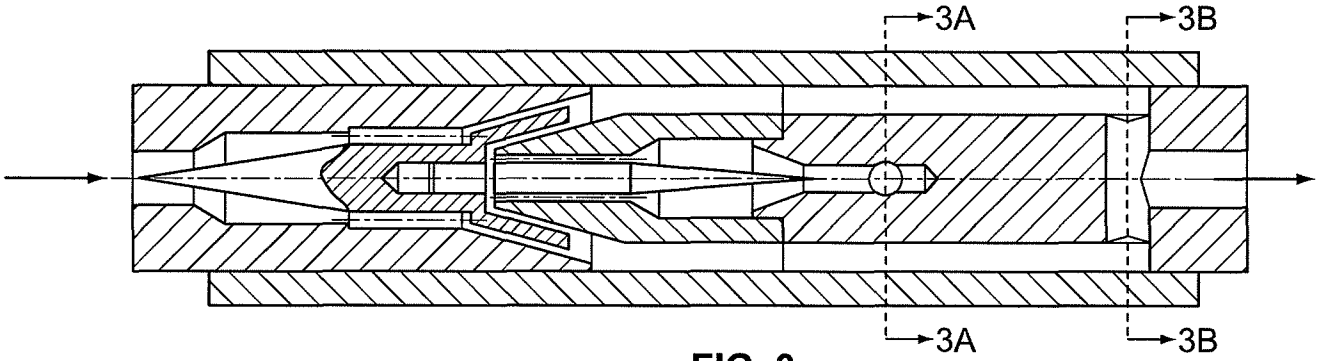
FIG. 3 is a cross-section of the device for producing a fluid composite of FIG. 1 where the outlet of the device includes an X shape concentrator for the fluid composite according to another embodiment of the present disclosure.

FIG. 1 and associated FIG. 3 illustrate an incoming stream 101 of incompressible liquid made in one embodiment of hydro-carbons or a fuel. A hydraulic section of the device 102 is connected to an inlet such as a fuel pipeline or any other connector. As the stream 101 travels up the device illustrated here from left to right, it passes an entrance 103 and is split outwardly over a conical reflector 104. At the base of the conical reflector 104, the fuel reaches the opening channels 107 in the shape of a ring after traveling in the fixed external diameter cavity 106 where the fluid is accelerated. The stream 101 is split and enters the channels 107 and then reaches ring channel 109 to create a homogenous turbulent stream after a second step acceleration. Element 108 is an alignment element to help assemble and align the hydraulic and pneumatic parts.

The gas from an external source enters at channels 122 and travels up 121 until it expands at 120 around a conical shaped section. Another inner cone 119 serves as a guide element to direct the gas past the zone 117 and because of a reduction in section around the code to accelerate the gas into another ringed area with channels 116. After the gas is flipped at the tip of the channels 116, it then moves down opened channels 115 to meet the turbulent fluid. The fluid and the gas pass on opposite sides of the double coaxial reflector 111 before entering and mixing into the ring channel 112 and ultimately the ring 113 where merger and formation of the fluid composite 1 occurs. Line 114 illustrates the border at which the fluid composite 1 is formed and ultimately travels down the channels 123 for the accumulation of the fluid composite down in the apertures 124 into a single stream at the axial aperture 125. A casing 127 is used for example as a heat sink or is used to help with post processing and alteration of a characteristic of the fluid composite 1 after it is formed. Greater details are given of this device and apparatus in the parent application hereby fully incorporated by reference.

Figure 3B:
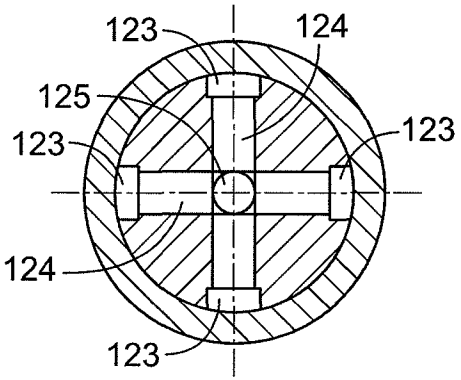
FIG. 3B is a view from FIG. 3 taken at line 3B-3B illustrating a possible X shate fluid composite concentrator.
Figure 3A:
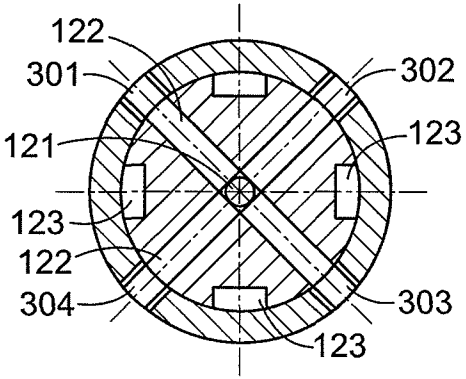
FIG. 3A is a view from FIG. 3 taken at line 3A-3A illustrating a possible X shape gas inlet system according to an embodiment of the present disclosure.

FIG. 3 describes shows as 3A and 3B two sections, the first where a gas enters the device 100 and where the fluid composite 1 where the fluid composite 1 evolves. At FIG. 3A air or compressed gas enters at 301 at apertures for fastening pipelines where air arrives from a compressor. The gas evolves up channels 122 and reach the center 121 where the air then proceeds upwards to the area for the production of the fluid composite 1. FIG. 3A further illustrates four channels 123 where the fluid composite 1 travels back to the area illustrated by FIG. 3B. In FIG. 3B the fluid composite 1 after traveling down from the main portion of the device past the area shown at 3A merges back via channels 124 to the axial aperture 125. Both FIGS. 3A and 3B show a X shape system with four apertures or four channels for the transfer of the gas and the fluid composite 1 respectively, but one of ordinary skill in the art will recognize that while one possible configuration is shown, any geometry, number of apertures, or number of channels is contemplated.

Figure 4:
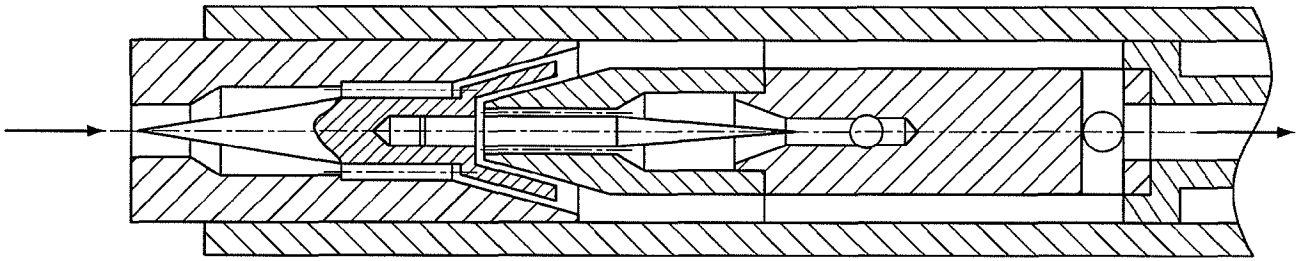
FIG. 4 is a cross-section of the device for producing a fluid composite of FIG. 3 including a post production chamber used to further alter the fluid composite according to another embodiment of the present disclosure.

FIG. 4 is a cross-section of the device for producing a fluid composite of FIG. 3 including a post production chamber is used to further alter the fluid composite according to another embodiment of the present disclosure. At the back end (right side on the figure), an area is reserved 401 for post processing of the fluid composite 1 before it is released. For example, the device can include a coil or a cooling element to alter the temperature of the fluid composite 1.

Figure 5:
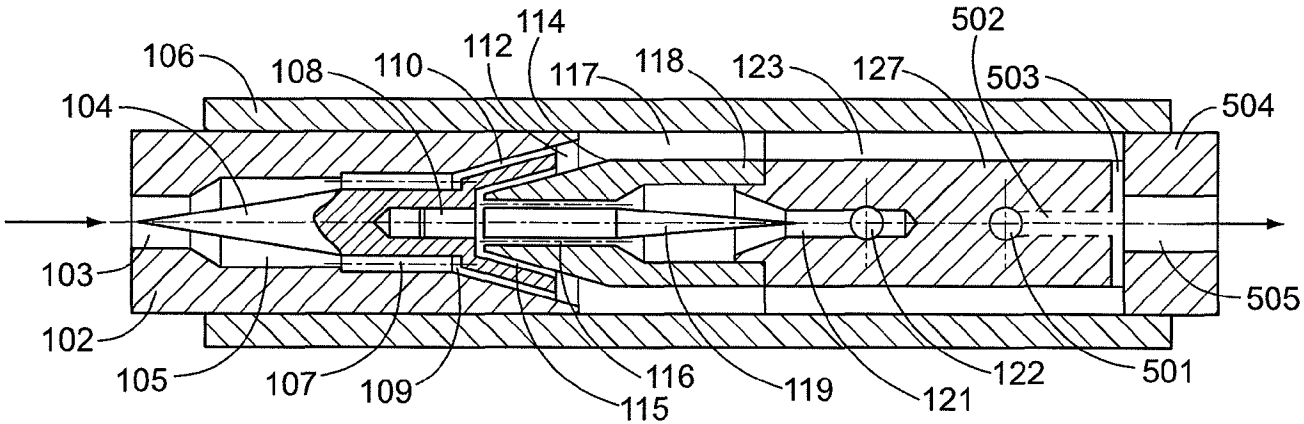
FIG. 5 is a cross-section of the device for producing a fluid composite of FIG. 1 including an acceleration nozzle for entry of a secondary fluid into the fluid composite according to an embodiment of the present disclosure.
Figure 6:
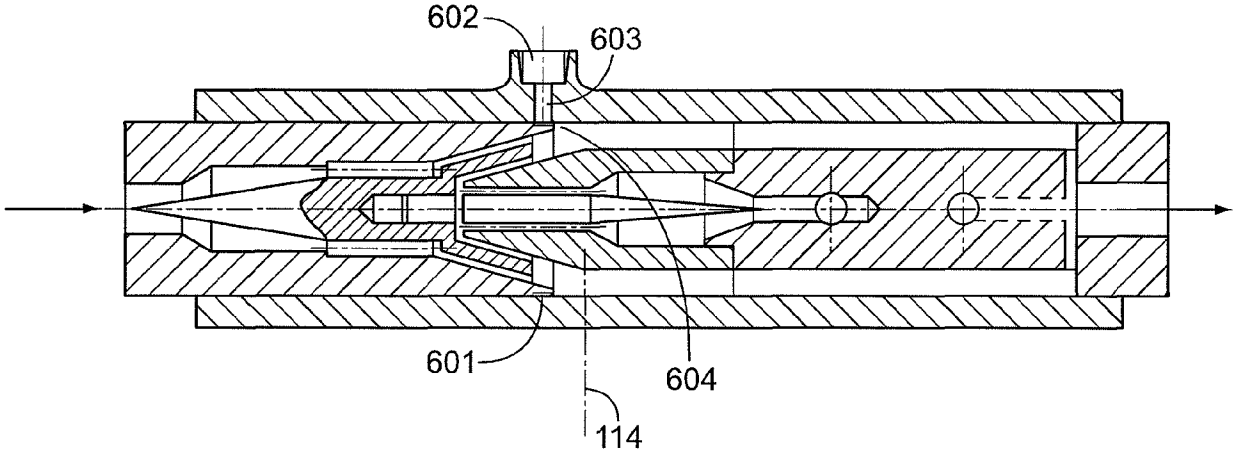
FIG. 6 is a cross-section of the device shown at FIG. 5 further including a secondary fluid inlet according to an embodiment of the present disclosure.
Figure 7:
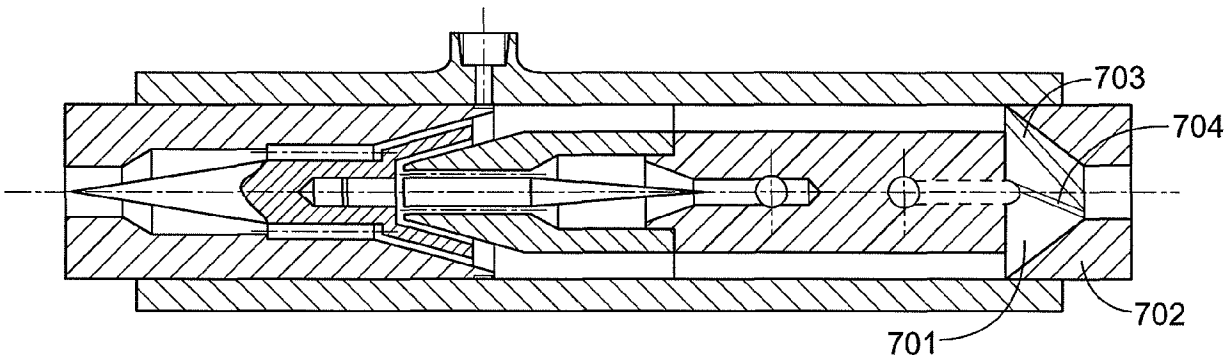
FIG. 7 is a cross-section of the device for producing a fluid composite of FIG. 5 wherein the acceleration nozzle includes conical shape vortex channels.

FIG. 5 is a cross-section of the device for producing a fluid composite of FIG. 1 including an acceleration nozzle 501 for entry of a secondary fluid such as air or water to be merged with the fluid composite 1 at 503 after it is released via the channel 502. The passageway 503 can be a flat vortex creator with inclined passageway or be on a conical shape section 703 as shown at FIG. 7. FIG. 6 is a cross-section of the device shown at FIG. 5 further including a secondary fluid inlet according to an embodiment of the present disclosure. Fluid pressurized or not is added such as additional combustion air to help push or accelerate the fluid composite 1 or simply to further increase the quantity of air in the mixture. The spiral 701 with tangential channels 704 is shown and is designed to create a vortex movement in the fluid composite 1 before it enters the outlet. FIG. 7 further includes an additional fluid inlet 705 for the entry of a fluid but this time directly in the area of the device 100 where the fluid composite 1 is created. FIG. 6 shows how a fluid inlet 602 includes an opening 603 for the passage of liquid into the area of interest 604. In the illustrated embodiment, a groove 601 can be made to help guide the incoming liquid to the area of interest 604.

What is described is a fluid activation device 100 to generate a aerated fluid composite 1 with a hydrodynamic portion in contact with the fuel 101 for activating at least a fuel by subsequently pressurizing the fuel 101 over for example a cone 104 and depressurizing the fuel 101 into a low pressure zone 113 for mixing of the liquid such as the fuel with a compressed gas entered via 122 to form a fluid composite 1 a shown on FIG. 2. The device 100 further includes an aerodynamic portion shown as elements 118, 119, and 127 overlapping with the hydrodynamic portion at an interface region with conical shaped reflectors 111 for mixing a compressed gas from an external source 122 such as a compressor into the at least an input compressed fuel 101 at the low pressure zone of mixing 113 by subsequently pressurizing the gas, and changing a flow direction of the gas into the fluid composite 1.

Further, the device 100 includes a secondary gas inlet 501 as shown at FIG. 5 to introduce gas or a different fluid into the fluid composite 1 to form an aerated fluid composite shown by the arrow on the right side of the device 100. In one embodiment, the hydrodynamic portion includes a housing 105 with a cavity having a center cone 104 for pressuring the liquid 101 and directing the liquid 101 to a plurality of channels 107 and ultimately to capillary ring channel 110 between two conical shaped surfaces 111 for depressurization into the low pressure zone 113.

In yet another embodiment, the secondary gas inlet 122 or as shown by a cross 301 on FIG. 3A is in a housing 127 of the aerodynamic portion 118, 119, and 127. In another embodiment, the aerated fluid composite 540 as shown on FIG. 5 is a fluid composite 1 with more than a stoichiometric volume of gas in weight or a regulated stoichiometric volume for further compression of the fluid composite 1. In FIG. 3A, the gas inlet 310 is radial to the housing, in another embodiment the housing further includes an external device for altering a characteristic of the aerated fluid composite 401 as shown on FIG. 1.

In addition to providing information about the fluid composite 1, and a device 100 for the production of the fluid composite 1, what is also contemplated is a system 1000 where the device 100 for producing the fluid composite 1 is connected functionally. FIGS. 8 to 11 illustrate respectively each of the devices shown at FIGS. 1, 5, and 6 respectively as part of an integrated functional system 1000 with a device 100 where the fluid composite is used.

The system 1000 as shown includes the device 100 for the production of a fluid composite 1. The system includes a compressor 806 with a pump and a nanometer 807 for the calibration and control of the flow of gas from the compressor 806 to the entry port 122 of the device 100. The second input is a fluid pumped up from a tank 801 having a gauge or a level 802 and is pumped via the pump 803 through a meter 804 or filters/gauge 805. In one embodiment, the tank 801 is filled with hydrocarbons or fuel. As drawn on FIG. 8, an additional tank 811 is used to collect surpluses of fluid composite that is settled down in an depressurized state through a gauge or safety valve 810 and is recycled into the tank 801. Finally, the fluid composite 1 produced by the device 100 is sent to a use, such as in one example an atomizer 8 for a combustion chamber 809. While one use and one configuration of the system 1000 is shown, what is contemplated is the use of the device 100 as part of any system, with any technology, that requires the fluid composite 1.

Figure 8:
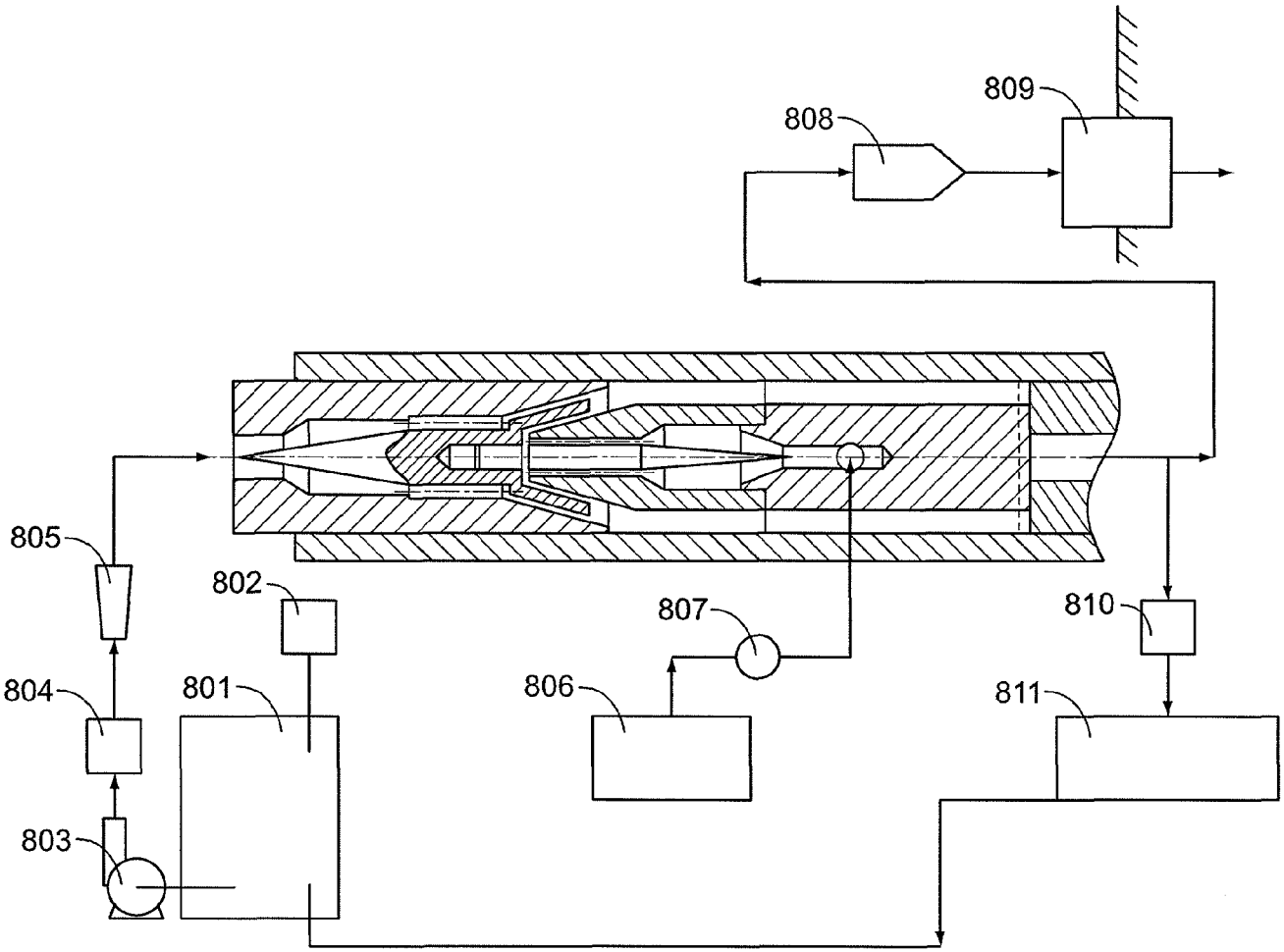
FIG. 8 illustrates an integrated functional system where the device for producing a fluid composite of FIG. 1 is used according to an embodiment of the present disclosure.

FIG. 9 shows the same structure as in FIG. 8 with the added description of the different zones for the creation of the fluid composite 1. These zones are described as zones 901 to 909. As described above, gas enters from the compressor 806 from one end while fluid enters from the tank 801 from the opposite end of the device 100. The steps 901 to 909 are listed in this succession as the fluid passes from 901 to 905, merges with the gas coming from the compressor 806 in zone 906 and finally moves out as shown in zones 907 to 909. Zone 901 is a state the fluid passes from a continuous cylindrical flow to a ring shaped flow. Based on the angle of the different cones in this region and the associated effective surfaces open to the flow of fluid, the speed of the fluid is increased, slowed, or unchanged. In the configuration as shown, the speed of the fluid is accelerated in zone 901 and enters zone 902 the ring shape is formed so it aligns with the channels in zone 903. Small streams of uniform cross section, such as cylindrical diameters of 5 to 50 micrometers are made. These channels have a fixed length so as to create a pressure drop in the fluid.

At zone 904, a buffer zone allows for the collection of a small quantity of fluid before it may continue down to zone 905 and is dispersed. Zone 905 is a conic ring dispenser where the distance can be up to 200 micrometers but in one embodiment, the distance is 5 to 50 microns. As the streams move in this zone, the streams split in zone 903 take on a unique dynamic and kinetic configuration. Expansion based on the Bernoulli principle further increases the dynamic configuration of the stream of liquid. At zone 906, the volume of the ring is such that pressure drops below a certain pressure so conditions of expansion and partial vaporization occurs. As observed, the flow downstream from zone 906 is of such a size as to allow for the ring at zone 906 to be in depression (i.e. where the flow is unclogged). At this border shown by 114 the fluid mixes in with the gas and the fluid composite 1 is formed in a partially compressible medium.

Zone 907 is a zone of intensive formation of cells of the fluid composite and a zone of high energy before the stream can stabilize in zone 908 as an accumulation of cells with a fixed pressure. Finally, at zone 909, this area includes in one embodiment a vortex creator capable of creating a spiral movement within the fluid composite 1 by using some internally stored energy in the composite 1.

Figure 10:
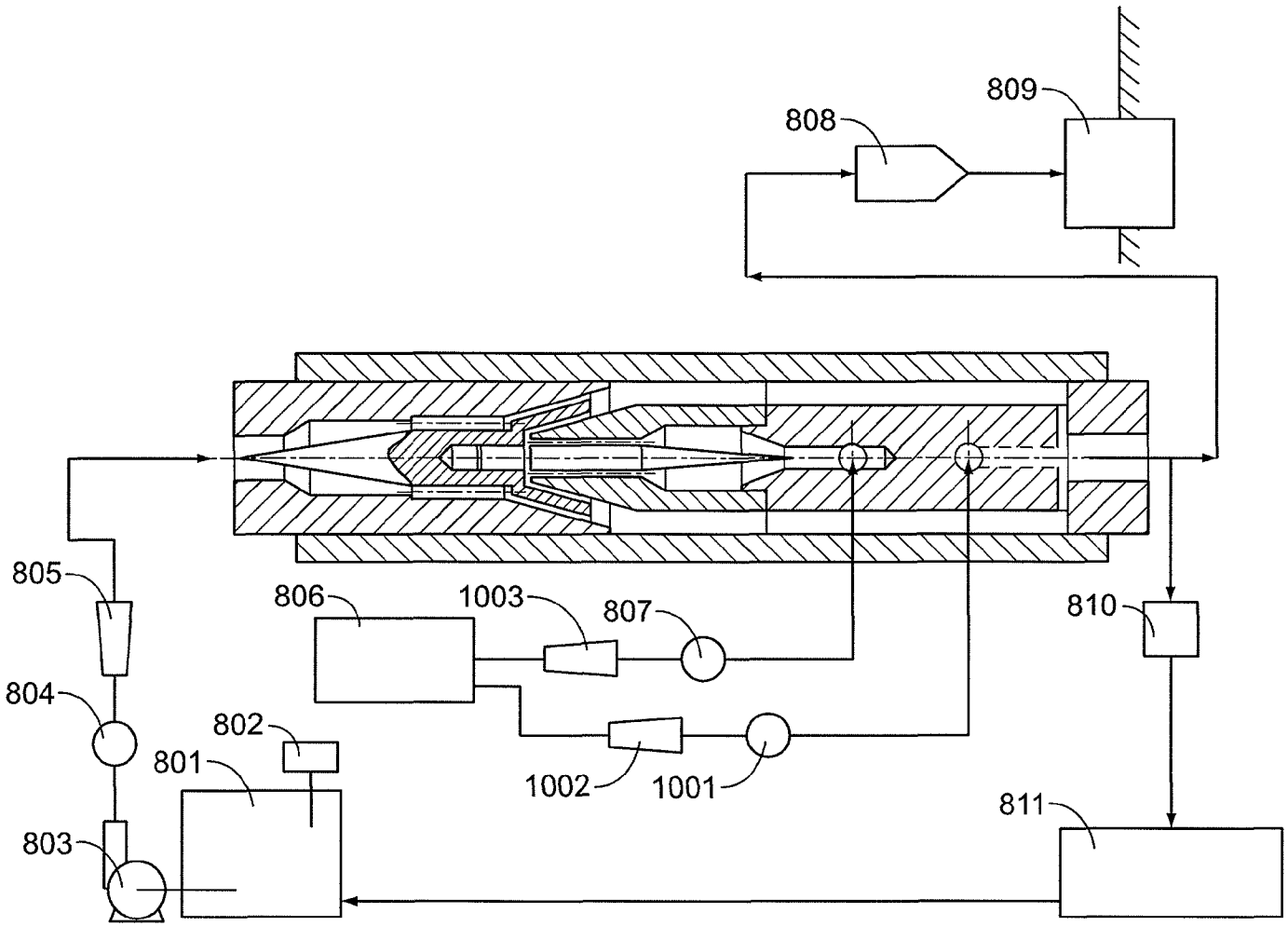
FIG. 10 illustrates an integrated functional system where the device for producing a fluid composite of FIG. 5 is used according to another embodiment of the present disclosure.
Figure 11:
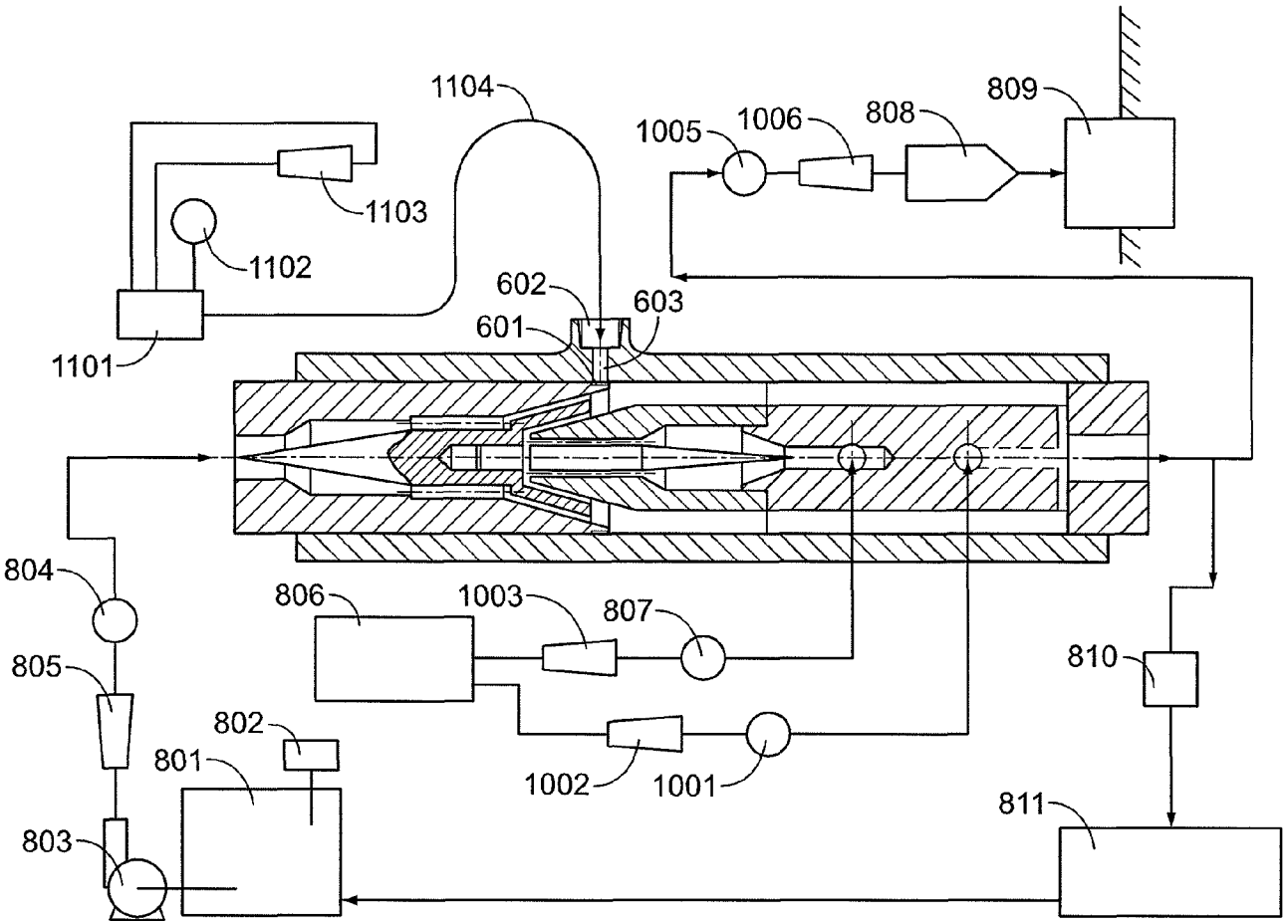
FIG. 11 illustrates an integrated functional system where the device for producing a fluid composite of FIG. 7 is used according to another embodiment of the present disclosure.

FIG. 10 shows the configuration of FIG. 8 where the system further includes a second source of compressed air connected to the compressor 806 via a nanometer 1001 and a gauge for the determination and calibration of the flow and charge of compressed air for calibration. The system further includes as shown a second gauge 1003 for the primary flow of air. Finally, FIG. 11 includes other elements of one possible embodiment of the system 1000 such as a connector 1104 for entering a second source of fluid at zone 905 using a reservoir 1101, a gage 1102, and a load charge gauge 1103. Other elements such as control elements 1005 and 1006 can be added to the use element 808 to better utilize the fluid composite 1 as a compressed media.

What is further described is a system 1000 for producing an aerated fluid composite with a source of fuel from the tank 801 connected to a hydrodynamic portion for activating at least a fuel in at least one of zones 901 by subsequently pressurizing the fuel 902 and depressurizing the fuel 903 into a low pressure zone for mixing 906 of the liquid with a compressed gas from the compressor 806 to form a fluid composite 1. The source of compressed gas 806 is then connected to an aerodynamic portion as shown on FIG. 9 overlapping with the hydrodynamic portion at an interface region shown at 905 for mixing a compressed gas into the at least an input compressed fuel at the low pressure zone 906 of mixing by subsequently pressurizing the gas, and changing a flow direction of the gas at zone 905 into the fluid composite 1 created at 907. The system 1000 also includes a secondary gas inlet 501 to introduce gas also from a compressor 806 or any other source into the fluid composite 1 and connected to the source of compressed gas to form an aerated fluid composite. In another embodiment, an aerated fluid composite outlet 766 is connected to an element 808 for use of the aerated fluid composite. The aerodynamic portion and the secondary gas inlet may also be connected to two different sources of compressed gas (not shown).

While in at least some examples described above, the fuel activation device is described generally as mixing fuel and water, the fuel activation device can mix various types of liquid components. For example, the fuel activation device can mix two dissimilar liquid components such as fuel and water. In some additional examples, the fuel activation device can mix two homogeneous components, such as gasoline and ethanol. In yet additional examples, the fuel activation device can mix at least three diverse components, such as gasoline, ethanol and water. In such embodiments, two of the components are provided to one of the liquid inputs to the hydrodynamic portion of the fuel activation device.

As shown in FIG. 13D, as the fuel-air mix stabilizes, the bubbles of fuel align to form a foam. While one regular quadratic cell configuration is shown, any configuration of optimized contact area based on the geometry of the cell is contemplated. In the stabilized fuel air mix, the average diameter of the fuel spheres (e.g., the diameter of the compressed gas core if present and the shell of fuel) becomes similar since the boundary conditions are the same across the entire fluid composite. While the average diameter of the fuel spheres is constant, the diameter of the kernel of compressed gas can vary between fuel spheres based on the local pressure of the fluid. For example, some fuel spheres, such as fuel sphere, have a core of a small or minimal diameter while other fuel spheres, such as fuel sphere, have a kernel that is so large that the coating on the fuel sphere has an insufficient thickness to provide stability due to forces of superficial tension. Smaller pressure allows for the gas kernel to expand creating a bubble with a smaller shell. Over time, fuel spheres such as fuel sphere are likely to burst. In some thermodynamic arrangements, in order to reduce the number of fuel spheres that burst prior to combustion, the time between formation of the foamed fuel and combustion of the fuel can be short.

In general, it can be desirable to form micro-bubbles having a ratio of the radius of the kernel of compressed to the thickness of the shell of liquid of between about 0.8 and 2.5 (e.g., between about 1 and about 2, between about 1.5 and about 2, about 2). Such a ratio again based on boundary conditions can provide a stable micro-bubble that is less likely to burst while still providing an increased surface area of the fuel. The foamed fuel (e.g., such as the fuel shown in FIG. 13D) is inserted into a combustion chamber. When injected into the combustion chamber during a running cycle, the kinetic parameters of the activated volume of the fuel mix, in combination with the large active surface area of an activated unit dose of fuel, makes the burning process highly efficient.

Test Results

Different flows of liquid diesel fuel were entered into the device as shown on FIG. 1 at 101. A rate of 7.5 gallons/hour, 4.5 gallons/hour and a rate of 2 gallons/hour, with an added weight ratio of 10% of the needed stoichiometric air used for burning to form composite fuel. The combustion performance was increased in the range of 25 to 45% in equal condition without the added air in the form of fuel. A reduction in toxic exhaust gasses has been observed. One parameter was adjusted, such as the pressure of the compressed air to regulate the nature and composition of the fuel composite 1. Upon expansion of the composite fuel, this mixture remain a composite.

Instead of 7.5 gallons of fuel producing 100 MJ of energy in one hour, the fuel composite made of 5.25 gallons of fuel and 89.25 gallons of air at a pressure of 17 bars will produce the same energy output, thus saving 2.25 gallons of fuel well within the range of 25 to 45%. Testing conditions were within 23% of calculated values and corresponds in a commercial boiler to an increase of fuel performance from a value of 75% to approximately 87%.

One term that may be used to described the liquid fluid composite 1 is an emulsion or micro-emulsion of liquid where the mixture inside the different droplets is of a geometry based on the different size of the structure of the device for the production of the emulsion. For example, the different channel are of a diameter to produce the emulsion or the fuel composite of determined size without the need of surfactants or other chemicals made to change the property of the fuel. In one embodiment, the flow rate of the different liquids/gas entering the device are varied to alter the pressure, geometry, and different dynamic proportions of the emulsion. The term fluid composite 1 as part of this disclosure must be construed to be, for example a highly structure mixture, with either microscopic structured mix or macroscopic structured mix as described and shown. Emulsions or what is generally described as highly structured mixtures or more generally composites can be used in many different fields of technology including for combustion chambers, in the food industry, in the pharmaceutical industry, or for general mixing of fluids, liquids, liquids and gas, or fuel and gas.

It is understood that the preceding is merely a detailed description of some examples and embodiments of the present invention and that numerous changes to the disclosed embodiments can be made in accordance with the disclosure made herein without departing from the spirit or scope of the invention. The preceding description, therefore, is not meant to limit the scope of the invention but to provide sufficient disclosure to one of ordinary skill in the art to practice the invention without undue burden.

What is claimed is:

1. A fluid activation device to generate a aerated fluid composite, comprising:

a hydrodynamic portion for activating at least a fuel by subsequently pressurizing the fuel and depressurizing the fuel into a first pressure zone for mixing of the liquid with a compressed gas to form a fluid composite;

an aerodynamic portion overlapping with the hydrodynamic portion at an interface region for mixing a compressed gas into the at least an input compressed fuel at the first pressure zone of mixing by subsequently pressurizing the gas, and changing a flow direction of the gas into the fluid composite; and a secondary gas inlet to introduce gas into the fluid composite to form an aerated fluid composite, wherein the hydrodynamic portion includes a housing with a cavity having a center cone for pressuring the liquid and directing the liquid to a plurality of channels and ultimately to capillary ring channel between two conical shaped surfaces for depressurization into the first pressure zone.

2. The fluid activation device of claim 1, wherein the hydrodynamic portion includes an additional inlet.

3. The fluid activation device of claim 1, wherein the housing includes a vortex creator for mixing the fluid composite with the additional gas and creating a vortex in the aerated fluid composite.

* * * * *